United States Patent [19]

Schmid

[11] 3,973,720

[45] Aug. 10, 1976

[54] PROTECTIVE CUSHIONING PAD

[75] Inventor: Donald E. Schmid, Kankakee, Ill.

[73] Assignee: Republic Packaging Corporation, Chicago, Ill.

[22] Filed: Aug. 5, 1974

[21] Appl. No.: 494,615

Related U.S. Application Data

[63] Continuation of Ser. No. 272,652, July 17, 1972, abandoned.

[52] U.S. Cl. ..... 229/14 C; 206/523; 229/DIG. 1

[51] Int. Cl.[2] ..... B65D 81/02; B65D 85/30

[58] Field of Search..... 206/523; 229/14 C, DIG. 1

[56] References Cited

UNITED STATES PATENTS

| | | | |
|---|---|---|---|
| 1,762,900 | 6/1930 | Todd | 206/45.28 |
| 3,061,166 | 10/1962 | Deeren et al. | 229/14 C |
| 3,542,282 | 11/1970 | Troth | 206/523 X |
| 3,565,243 | 2/1971 | Freeman | 206/523 |
| 3,655,112 | 4/1972 | Jeffers | 229/14 C |

*Primary Examiner*—Leonard Summer
*Attorney, Agent, or Firm*—Dominik, Knechtel, Godula & Demeur

[57] ABSTRACT

A protective pad formed from a single piece of substantially flat, resilient material formed into at least two discrete sections, each section being foldable with respect to another section along a full fold line therebetween and fold retention means consisting essentially of a metallic strip mounted on the material and traversing each of the fold lines between adjacent sections, the metallic strips permitting each of the sections to be folded with respect to the next adjacent section and retained in any preselected angularized folded position and alternatively permitting the sections to be unfolded with respect to one another and positioned in a flat or unfolded posture.

3 Claims, 12 Drawing Figures

PROTECTIVE CUSHIONING PAD

CROSS REFERENCE TO RELATED APPLICATION

This is a continuation of parent application Ser. No. 272,652, filed on July 17, 1972, in the name of Donald E. Schmid for PROTECTIVE CUSHIONING PAD and now abandoned.

BACKGROUND OF THE INVENTION

This invention is directed to protective cushion pads utilized for packaging articles in cartons or crates or vans in connection with the shipping, storage and handling of articles wherein it is desirable to protect the edges and corners thereof against damage by abrasions, shocks or the like.

It is known that a wide variety of articles are packaged and shiped from one location to another wherein it is necessary to appropriately package or crate the articles to be shipped. In many cases, such articles consist of electronic instruments, cabinets, desks, appliances, furniture, and a wide variety of other similar articles which have substantially rectangular or square-shaped edges. It will be appreciated that especially in connection with items such as furniture, or electronic instruments, it is necessary to package or crate these articles such that when they arrive at their ultimate destination, the articles are undamaged, either in terms of aesthetic appearance or functional utility.

In the past, articles such as the above have been packaged in various different ways, but in most cases, such packaging devices and techniques have been unsatisfactory. One method used to package such articles has been to employ packing material formed from shredded or wadded paper. Once the article is placed in the carton or crate, the packing material is stuffed into the packing carton or crate about the sides, back and top of the article, after which the carton or crate is closed. Clearly, a great volume of packing material must be utilized which can become an expensive added cost of the manufacturing, and it is clear that once the article has arrived at its final destination, the user must then remove all of this packing material and dispose of the same. This constitutes a a very tedious operation and also involves a waste elimination problem.

Another method which has been utilized to package articles such as electronic instruments or the like, has been to employ pre-formed cushions of a resilient material, such as expanded polystyrene or rubber. The packing cushions are pre-formed in that the cushions are molded so as to take on the contour of either the top or bottom, or both, of the article to be packaged, thereby permitting the article to be placed, for example, in a bottom pre-formed cushion after which a top pre-formed cushion is positioned atop the article and the article enclosed within the carton or crate.

Hence, the attempt has been made to effectively "sandwich" the article between the packing cushions within the carton. The difficulty with such packing material is the fact that usually such pre-formed cushions are relatively expensive to manufacture, since they must be formed or molded to fit the article. It is therefore necessary to employ costly molds and in addition, it is also clear that the shipping time involved in shipping the articles intended is directly dependent upon the supply of the pre-formed cushions. In other words, it is not possible to ship out the articles until a fresh supply of cushions is obtained. It will also be appreciated that due to the fact that such pre-formed cushions are molded to fit a particular article, such cushions cannot be used for any other articles which are of a different size, hence, there is limited applicability or interchangeability in utilizing such pre-formed cushions with respect to a wide variety of articles. Finally, such pre-formed cushions pose a storage problem in that they cannot easily be stored due to their bulk and volume. Hence, warehousing problems present themselves where a shipper deals in a volume of articles to be shipped and therefore must store a volume of these pre-formed cushions.

Some attempts have been made to improve upon packaging materials and methods such as exemplified in U.S. Pat. No. 3,555,137 issued in the name of John M. Carmody and assigned to the assignee of the present invention. As disclosed in this patent, pre-formed corner cushions are manufactured which are utilized to protect each of the square corners formed by an article of manufacture, such as a piece of furniture, a cabinet, or the like. The corner cushions described and claimed therein are formed from an elongated tube formed of a foamed polyethylene or other similar material, and apparatus is provided for simultaneously cutting a formed three-faced corner cushion wherein the three interior faces are normal with respect to one another. Each of these cushions will then accommodate the insertion therein of a corner of an article, and when one of these cushions is placed on each of the corners of the article, effective packing means is provided for both protecting the corners against damage, as well as preventing vibrational shock or other forces from injuring or damaging the article cartoned or crated.

While the corner cushions as exemplified by the above-noted patent are extremely useful for the purpose intended, nevertheless, certain other problems are inherent in such construction. For example, it is apparent that, again, a storage problem is involved in storing and warehousing such corner cushions, since they are pre-formed and therefore take up valuable warehousing space. In addition, where certain articles have corners which are not completely square, it may be difficult to apply such corner cushions to these articles at any of such non-square corners during the packaging procedure.

SUMMARY OF INVENTION

The present invention provides a protective cushion pad formed from a single sheet of substantially flat, resilient material, the material being formed into at least two sections, which are foldable one with respect to the other, and having fold retention means mounted on the material and traversing the fold line between adjacent sections, the fold retention means permitting the sections to be folded in preselected angularized positions with respect to one another and retained in that position while alternatively permitting the sections to be unfolded to be stored in a flat posture prior to use. In addition, the protective cushion pad of the present invention is formed from a single sheet of substantially flat, resilient material with very little wastage during the formation of the protective pad, the only wastage involving the cut out slots which are necessary in order to achieve the mounting and positioning of the fold retention means with respect to each of the sections. Finally, the protective cushion pad of the present invention may be optionally provided with end apertures suitable for accommodating fastening means such as belts, straps or the like whereby a plurality of such pads may be interconnected, thereby to protectively package the article to be packed.

OBJECTS AND ADVANTAGES

It is therefore the principal object of the present invention to provide a protective cushioning pad for protecting the edges and corners of articles to be packed, which is formed from a sheet of substantially flat, resilient material, the material formed into at least two discrete sections, the sections being foldable with respect to one another along a fold line therebetween, and fold retention means mounted on the sheet material and traversing the fold line positioned between adjacent sections for alternatively retaining the sections in any pre-selected angularized position of one section with respect to another, while permitting the sections to be unfolded into a flattened unfolded position prior to use.

Another object of the present invention is a protective cushioning pad useful for packing articles having edges and corners wherein the pad is formed by two discrete sections, the sections each being foldable with respect to one another and having fold retention means traversing the fold line therebetween, whereby the two sections may be folded into any preselected angularized position with respect to one another and retained in that position while permitting the two sections to be unfolded and disposed in a flat disposition prior to use.

Still a further object of the present invention is to provide a protective cushioning pad of the type formed by two discrete sections are described above, which further includes diametrically opposed fastening apertures for accommodating there-through a cord, belt, strap or other similar fastening device, thereby permitting a series of such protective cushioning pads to be interconnected about the article to be packaged.

Yet a further object of the present invention is to provide a protective cushioning pad which is formed from a single sheet of substantially flat resilient material, with a minimum of material wastage, the pad being formed into three discrete sections, consisting of a corner section, a first peripheral section connected to and foldable with respect to the corner section along a fold line therebetween and a second peripheral section connected to the corner section adjacent to the first peripheral section and foldable with respect to the corner section along a fold line therebetween, and fold retention means mounted on the sheet material and traversing each of the fold lines whereby the first and second peripheral sections are each foldable with respect to the corner section and may be independently retained in any preselected angularized position with respect to the corner section thereby to form a three-faced corner cushion pad.

Another object of the present invention is the provision of a three-faced corner cushion pad of the type described above, wherein the only wastage in the material forming the subject three cornered cushion comprises the material cut off to form a pair of slots cut into the sheet material.

A further object of the present invention is to provide a protective cushioning pad of the type described above, wherein the fold retention means are each formed from elongated metallic strips, each metallic strip being sufficiently malleable to permit consecutive folding and unfolding of the same.

In connection with the foregoing object, the object is to provide a protective cushioning pad of the type described wherein each of the metallic strips is formed from a cadium plated mild steel which has great fatigue strength and yet is rigid enough to maintain the discrete sections at any preselected angular disposition.

In connection with the foregoing object, it is still another object to provide a protective cushioning pad of the type described wherein each of the metallic strips are sealed to the sheet material and so disposed as to intersect the respective fold lines formed between adjacent sections.

Another object of this invention is to provide a protective cushioning pad of the type described wherein the sheet of material is formed from a polyethylene foam.

Further features of the invention pertain to the particular arrangement of the parts whereby the above-outlined and additional operating features thereof are attained. The invention both as to its organization and method of operation, together with further objects and advantages thereof will better be understood by reference to the following specification taken in connection with the accompanying drawings in which.

Figure 9:
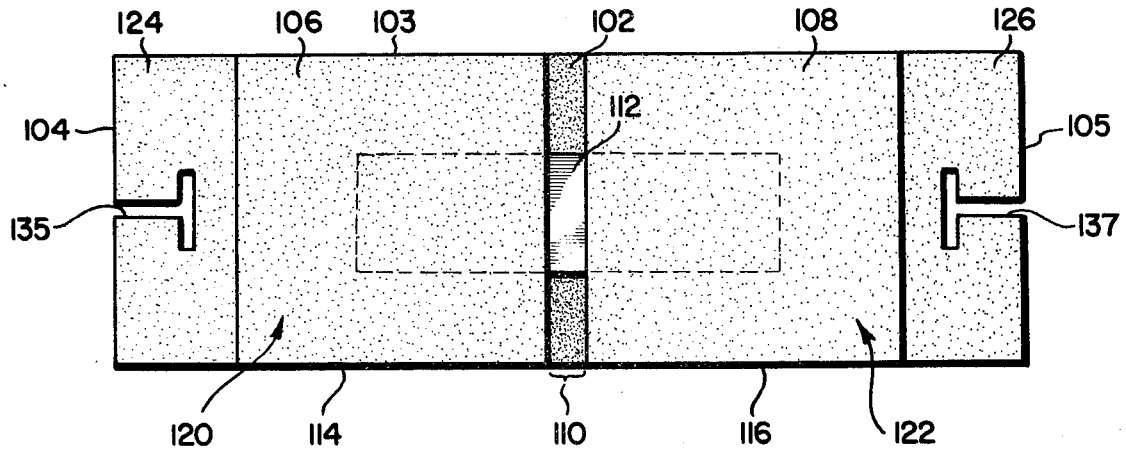
FIG. 9 is a top plan view showing still another embodiment of a two sectioned protective cushioning pad of the present invention wherein the end tabs are provided with T-shaped cut out apertures to accommodate the threading of a band there-through and interconnecting a series of similar such protective cushioning pads.
Figure 10:
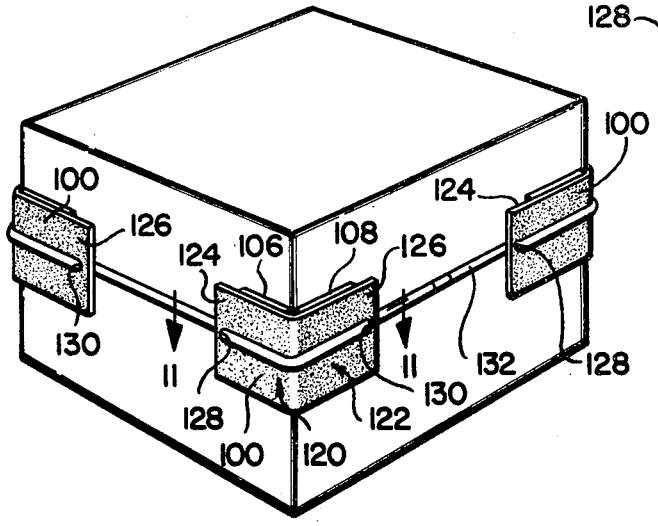
FIG. 10 is a perspective view showing an article protectively packaged with a series of protective cushioning pads of the type shown in FIGS. 6 and 7 of the drawings, the tabs being interconnected by a band threaded through the end tab apertures.
Figure 11:
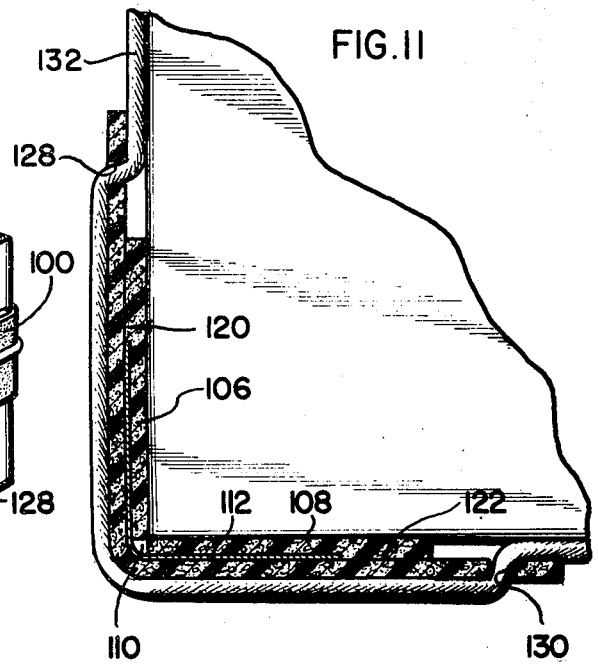
Figure 12:
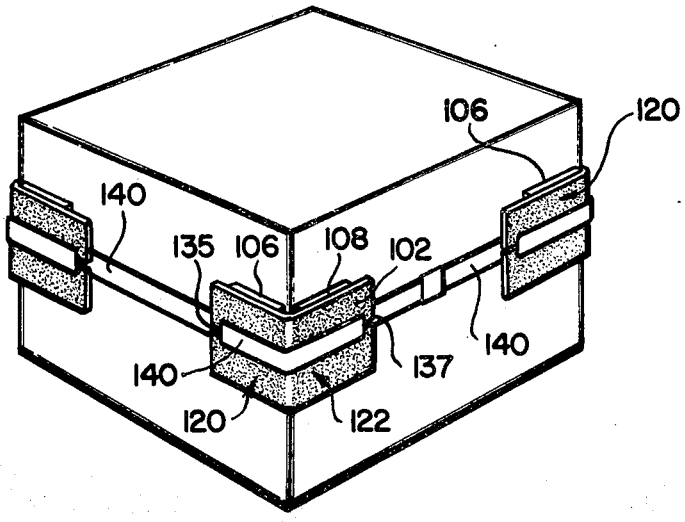

FIG. 11 is a side cross-sectional view showing the means of threading a cord through the protective cushioning pad taken in the direction of the arrows along the line 11—11 of FIG. 10; and, FIG. 12 is a perspective view showing the interconnection of a series of protective cushioning pads of the type disclosed in FIG. 9 interconnected by means of a flat band of the type commonly used in packaging articles.

Figure 1:
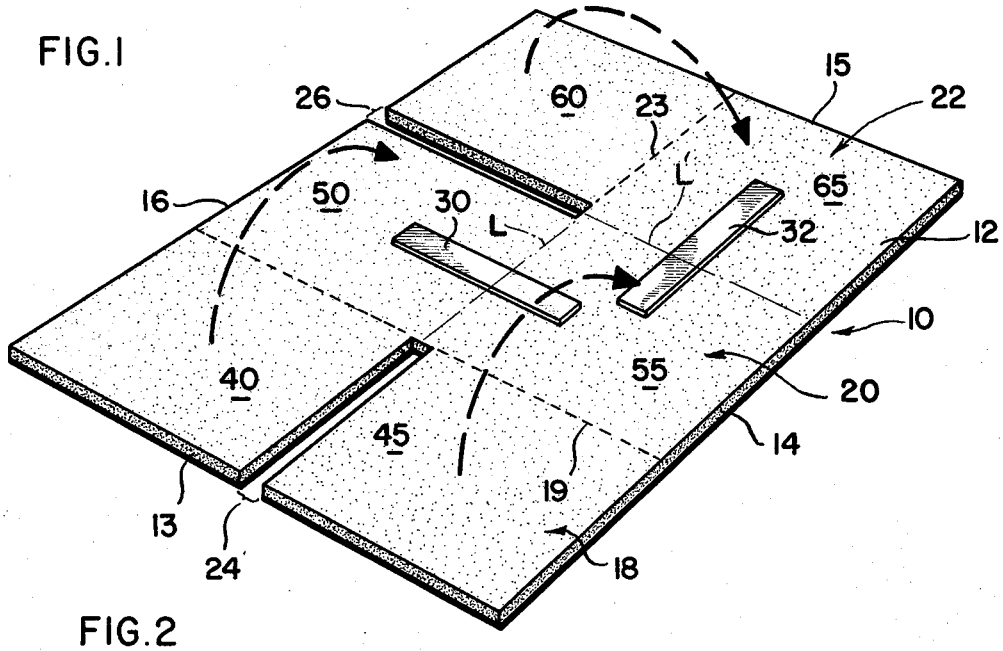
FIG. 1 is a perspective view showing a piece of flat sheet material having a series of two slots cut out therefrom and fold retention metallic strips in position to form a three-faced protective corner cushioning pad illustrating one embodiment of the present invention.
Figure 2:
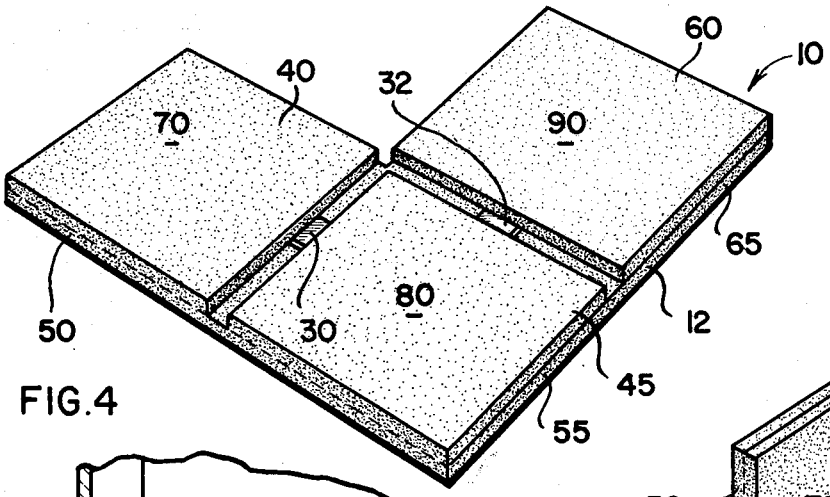
FIG. 2 is a perspective view showing the three-faced corner cushion as assembled and in the flat unfolded disposition.
Figure 3:
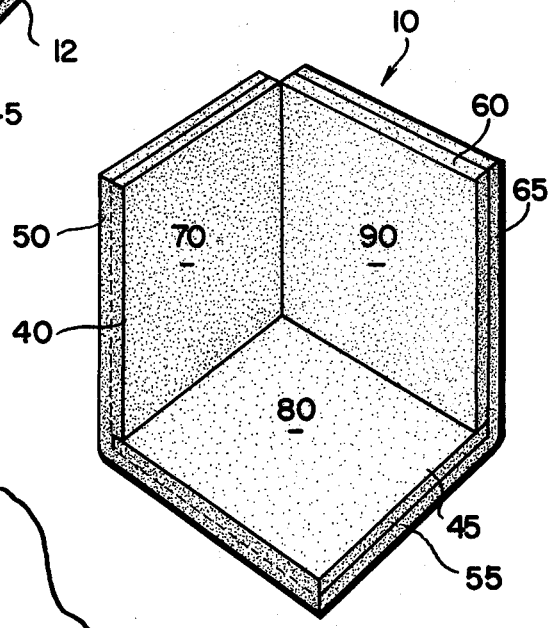
FIG. 3 is a perspective view of the three-faced corner cushion cushioning pad of FIG. 2 wherein all of the appropriate sections are in the folded disposition thereby to form an interior cavity for enveloping an article corner.

With reference to FIGS. 1 through 3 of the drawings, the structured configuration of one of the embodiments of a protective cushioning pad of the present invention is illustrated. In the embodiment illustrated therein, a three-faced protective cushioning pad is illustrated. In FIGS. 5 through 8 of the drawings, a second embodiment of a protective cushioning pad of the present invention is illustrated wherein each of the protective cushioning pads is formed into a two-section pad having a single fold line therebetween and a single fold retention means traversing the fold line. Protective cushioning pads of the type illustrated in FIGS. 5 through 12 of the drawings are particularly useful for protecting exposed edges of any article to be packaged and shipped whereas the protective cushioning pads as shown in FIGS. 1 through 3 of the drawings are particularly suited for protecting exposed corners of articles to be packaged and shipped.

With reference to FIGS. 1 through 3 of the drawings, the particular structure and configuration of the novel three-faced corner cushion of the present invention is illustrated. The three-faced corner cushion of the present invention is generally referred to by the numeral 10, and preferably and advantageously is formed form a single piece of sheet material 12, which as shown in FIG. 1 is basically rectangular in configuration.

For ease of description, the long side edges shall be referred to by the numerals 14 and 16, and the shorter side edges shall be referred to by the numerals 13 and 15. The single sheet material 12, is divided into three equal sections along the longer dimensions of the rectangular configuration, represented by the numerals 18, 20 and 22 respectively. The first section 18 is shown to be again divided into two equal sections via a first cut out slot 24, the slot 24 extending from the short side edge 13 inwardly to the fold line 19, separating the first section 18 from the second section 20.

A second cut out slot 26 is cut into the sheet material 12 from a point along side edge 16 to a point substantially midway between the long side edges 16 and 14, the second cut out slot 26 being positioned in substantially normal relation and spaced from the first cut out slot 24. In addition, a second fold line is provided across the third section 22 whereby the third section 22 is essentially divided into two equal portions.

Again, as viewed in FIG. 1 of the drawings, a first elongated metallic strip 30 is mounted on the center section 20 of the sheet material 12, the first metallic strip 30 being so mounted as to traverse the line L connecting the first cut out slot 24 with the second fold line 23. A second elongated metallic strip 32 is provided, the second strip 32 being mounted on a sheet material and intersecting the line L′ extending from the second cut out slot 26 to the opposed side edge 14. Each of the metallic srips 30 and 32 respectively may be mounted to the sheet material via any appropriate means such as adhesive, heat sealing, or the like.

As mentioned above, the first cut out slot 24 divides the first section 18 into two equal portions, hereinafter designated as portions 40 and 45. The center or second section 20 may similarly be viewed as having two equal sections, hereinafter designated as sections 50 and 55 respectively. And finally, the third section 22 is again divided into two equal portions via second fold line 23, the two portions of section 22 being designated as 60 and 65 hereinafter.

In order to form the three-faced corner cushion of the present invention, portion 40 of sectin 18 is folded over and atop the portion 50 of section 20 by folding portion 40 along the first fold line 19 and in the path of travel as indicated by the dotted arrow in FIG. 1. As will be noted from viewing both FIG. 1 and FIG. 2 of the drawings, once portion 40 has been folded over onto portion 50 along fold line 19, a part of the first metallic strip 30 will be sandwiched between said portions 40 and 50. In a similar manner, the portion 45 of section 18 is similarly folded over and atop portion 55 of section 20 by folding the same along fold line 19 in the direction of the dotted arrow as shown in FIG. 1. In the stacked relationship as between portions 45 and 55, it will be observed that portion 45 not only sandwiches the remaining part of the first metallic strip 30 but also sandwiches therebetween a part of the second metallic strip 32, between portion 45 and 55.

The construction is completed by cross folding portion 60 over and on top of portion 65 of the section 22, portion 60 being folded along the second fold line 23 and in the direction of the path of travel represented by the dotted arrow in FIG. 1, As will be observed from viewing FIG. 2, once portion 60 has been folded along fold line 23 and onto portions 65, the remaining part of the second metallic strip 32 will be sandwiched between portions 60 and 65 respectively. Having completed the assembly as set forth above, the three-faced corner cushion will have the structure and configuration as shown in FIG. 2 of the drawings.

Both the first and second metallic strips are formed of a metal which is extremely malleable, such that the metallic strips 30 and 32 may be bent with the application of only a minimal amount of manual force. For example, metallic strips formed a cadium coated mild steel or tin alloy or any other suitable alloy which is malleable may be utilized in connection with the present invention. As previously indicated, the metallic strips 30 and 32 may be mounted to the sheet material 12 by means of any suitable mounting means such as adhesive, heat sealing or the like.

In order to ensure a solid construction when the portions 40, 45 and 60 are folded over and atop the corresponding portions 50, 55 and 65 respectively, a suitable adhesive may be employed in order to achieve a good face-to-face bonding as between the corresponding portions. It is apparent that if the sheet material 12 is formed of a polyurethyene foam, or other similar type of plastic, a wide variety of adhesives may be employed in order to firmly secure the corresponding portions 40 and 50, 45 and 55, and 60 and 65 to one another.

Figure 4:
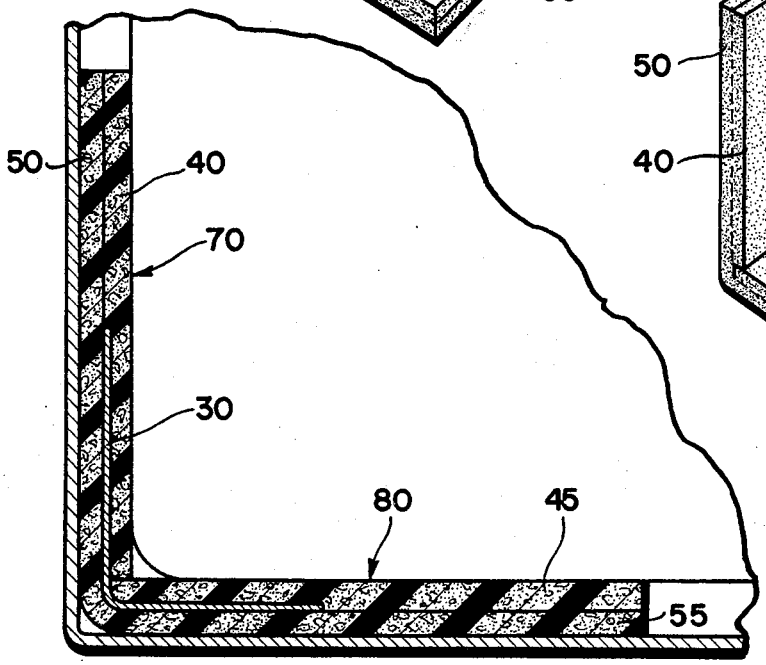
FIg. 4 is a cross-sectional view, partly broken away illustrating the protective cushioning pad of the present invention as used in connection with its intended utilitarian purpose.

Once the three-faced corner cushion of the present invention has been assembled and assumes the configuration as shown in FIG. 3 of the drawings, the three cornered cushion 10 assumes an L-shaped configuration formed by a connecting series of three block units, 70, 80 and 90 respectively. The corner cushion 10 may be conveniently defined as having a L shaped configuration, including a base portion formed by block units 80 and 90, and an arm portion formed by block units 70 and 80, respectively. As indicated previously, the base portion of the L is formed by folding block portion 60 over onto the block portion 65 along the fold line 23, while the aarm portion of the L is formed by folding block portions 40 and 45 over onto enjoining block portions 50 and 55 respectively along fold line 19. The completed corner cushion 10 in flat disposition and assuming an L-shaped configuration is shown in FIG. 2 of the drawings. When it is desired to utilize one or more of the corner cushions 10 of the present invention, the operator need only bend the three block units 70, 80 and 90 respectively toward one another, that is, folding block unit 70 upwardly with respect to block unit 80 and similarly bending block unit 90 upwardly with respect to block unit 80, thereby to form the configuration as shown in FIG. 3 of the drawings. It will be apparent that an innterior cavity is formed by the inner faces of the block units 70, 80 and 90 respectively and the same accommodate a corner of an article to be packaged such as an article of furniture, as will be observed in FIG. 4 of the drawings. In addition, in the event it is desired to package an article which does not have a squared off corner, clearly either of block units 70 and 90 may be bent over block unit 80 until an acute angle is formed between the inner face of either block units 70 and 90 and, block unit 80, thereby better protecting the article to be packaged.

One of the principal advantages derived from the present invention is the fact that the amount of wasted material is greatly minimized. In fact, the only wasted material from the single sheet of material 12 is the material lost from the two cut out slots 24 and 26 respectively. Clearly, such as saving in terms of material will reduce the manufacturing costs incident to making the three cornered cushions of the present invention while at the same time obtaining a corner cushion which is more useful than those of the prior art.

It will further be observed that by providing the cut out slots 24 and 26 respectively, once the three-faced corner cushion 10 of the present invention has been assembled in the manner indicated above, to form the cnfiguration as shown in FIG. 2 of the drawings, the width of each of these cut-out slots 24 and 26 respectively is preserved afte the portions 40 and 50, 45 and 55, and 60 and 65 have been brought together and secured into position. As a result of this construction, when block uniit 70 is bent over towards block unit 90, and when block unit 90 is similarly bent over toward block unit 80, a neat interfitting relationship is achieved between the block units 70 and 80 respectively, all as shown in FIG. 3 of the drawings.

With respect to dimensions, it is apparent that the corner cushion 10 of the present invention may be formed of a single sheet of material of any dimension. The only limitation resides in the types of articles to be packaged or, alternatively the size of the crates to be utilized in packaging such articles. However, it has been found that a corner cushion 10 of the present invention, formed from a single sheet of plastic material measuring 12 inches by 8 inches will result in a corner cushion which is useful for virtually most applications. In such a preferred embodiment, each of the portions 40, 45 and 60 will measure approximately 4 inches in length by 3½to 3¾ inches in width. These dimensions assume that each of the cut-out slots 24 and 26 are approximately one-half inch in width and in the preferred embodiment, a half inch cut out slot is to be preferred. Hence, the only amount of material which is wasted comprises a strip approximately one-half inch wide and no more than 4 inches long which would be considered minimal wastage in the formation of such corner cushions.

Figure 5:
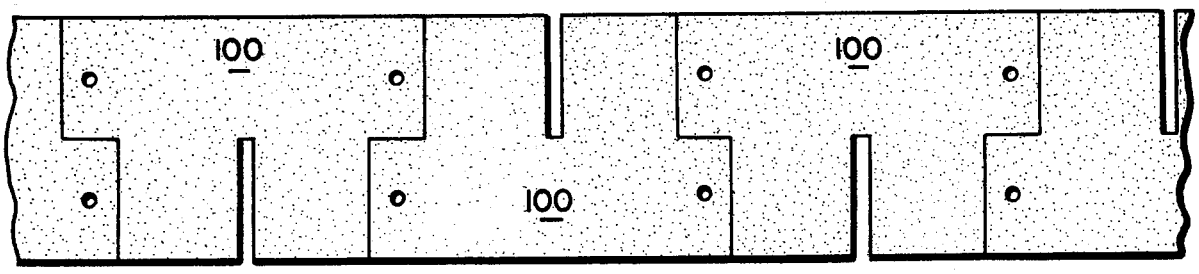
FIG. 5 is a top plan view showing a roll of sheet material as the same is initially processed for cutting to form a protective pad illustrating a second embodiment of the present invention.
Figure 6:
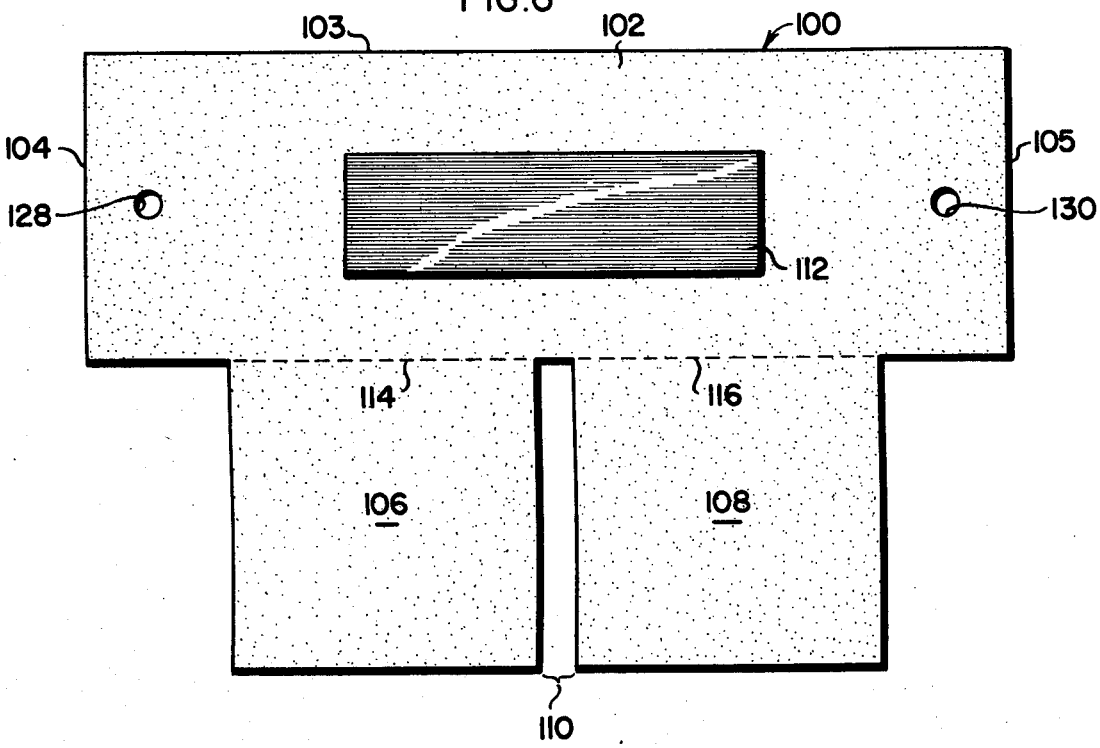
FIG. 6 is a top plan view showing a piece of sheet material having an appropriate slot cut out therein and preliminary to final assembly for forming a two section protective pad in accordance with the present invention including end tab apertures for accommodating a connective band.
Figure 7:
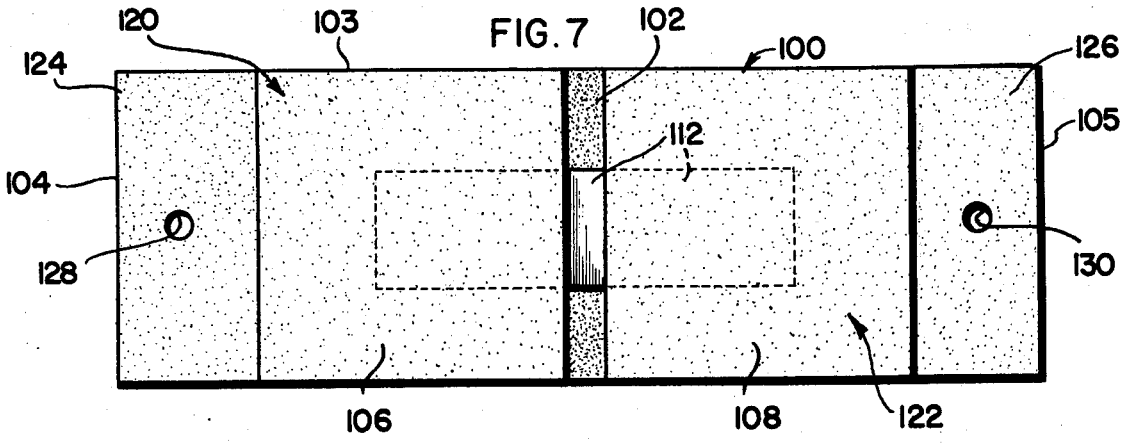
FIG. 7 is a top view showing the protective pad of FIG. 6 as assembled and with the fold retention metallic strip in position traversing the fold line between adjacent sections.
Figure 8:
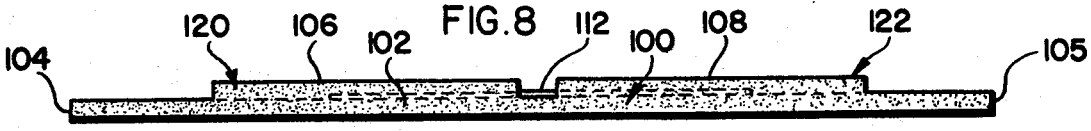
FIG. 8 is a side elevational view of the protective pad shown in FIG. 7 illustrating the sandwich effect utilized to form protective pads of the present invention.

With reference to FIGS. 5 through 12 of the drawings, other embodiments of protective cushioning pads of the present invention are illustrated. More particularly, a protective cushioning pad formed by two discrete sections is illustrated. With reference to FIGS. 6 and 7 of the drawings, a single sheet of flat resilient material 100 is provided, the sheet material 100 being in substantially a T-shaped form. The top portion of the T-shaped configuration comprises an elongated section 102 bounded by a top peripheral edge 103 and opposed short edges 104 and 105 respectively. The base portion of the T-shaped configuration is divided into two equal portions 106 and 108 respectively, the two portions 106 and 108 being divided by cut out slot 110. the fold retention means comprises an elongated metallic strip 112 and is shown to be positioned and permanently secured to the elongated section 102 traversing an imaginary line interconnecting the cut out slot 110 with the top peripheral edge 103.

Each of the two portions 106 and 108 is foldable with respect to the elongated section 102, along fold lines 114 and 116 respectively.

To complete the assembly of the protective cushioning pad, the two portions 106 and 108 are each folded over and on top of the elongated section 102, along the fold lines 114 and 116 respectively, whereby each of the portions 106 and 108 covers a substantial portion of the metallic strip 112. The completed assembly is shown in FIG. 7 of the drawings, and as illustrated therein, once the assembly has been completed, a protective cushioning pad consisting of two blocks, 120 and 122 respectively is formed.

With regard to the embodiment as shown in FIGS. 6 and 7 of the drawings, it will be noticed that the elongated section 102 has a pair of end tabs 124 and 126 respectively, each of the end tabs 124 and 126 being provided with an end tab aperture 128 and 130 respectively. The end tab apertures 128 and 130 accommodate the insertion therethrough of a packing cord 132, as indicated in FIG. 10 of the drawings. As shown therein, a series of four of the protective cushioning pads as illustrated in FIGS. 6 and 7 of the drawings may be utilized to protectively cushion the side edges of an article to be packaged, the four protective cushioning pads being held in fixed position with respect to one another and with respect to the packaged article by means of the packing cord 132. The packing cord 132 is threaded from the underside of end tab 124 and through the end tab aperture 128, across the back surface of the pad and back through the end tab aperture 130 exiting through the underside of tab 126. Due to the fact that the protective cushioning pad 100 is formed of a resilient material, the packing cord 132 may be tightened into any desirable tensioning point during the packaging procedure. It will also be apparent that in the event the article to be packaged is elongated in configuration, a plural series of four each of the protective cushioning pads may be banded about the packaged article along the elongated length thereof.

With reference to FIGS. 9, 11 and 12 of the drawings, a slight modified version of the protective cushioning pad of the present invention is illustrated. In view of the fact that the embodiment as shown in FIGS. 9, 11 and 12 of the drawings is similar with respect to the embodiment shown in FIGS. 6 through 8 of the drawings, like referenced numerals are utilized for like parts. The principal difference between the embodiment is more particularly shown in FIG. 9 of the drawings, and the embodiment as shown in FIG. 7 of the drawings, is the form of end tab aperture provided. As shown in FIG. 9, end tab 124 is provided with a T-shaped aperture 135 while end tab 126 is provided with a similar T-shaped aperture 137. As shown in FIG. 11 of the drawings, where it is desirable to use the flat type packing band 140 of the type commonly known in the art, a protective cushioning pad of the type illustrated in FIG. 9 is utilized. In this manner, again as illustrated in FIG. 12, a plurality of four protective cushioning pads as illustrated therein may be employed for each of the side edges of the packaged article, the series of four protective cushioning pads being held in fixed juxtaposition with respect to one another, and with respect to the packaged article by means of the flat type packing band 140.

Once again, with respect to the protective cushioning pads are illustrated in FIG. 5 through 12 of the drawings, these pads are made with a minimum of material wastage thereby decreasing the manufacturing cost incident to the manufacture thereof. As shown in FIG. 5 of the drawings, the T-shaped configuration of the cushioning pad is cut from a single roll of material such as polyethylene foam by means of a staggered die whereby each adjacent T-shaped body is inverted with respect to the next adjacent T-shaped body, thereby to produce the configuration as shown in FIG. 6 of the drawings. Hence, the only wasted material is the material which is cut out to form the cut out slot 110 with respect to each of the protective cushioning pads formed, and the material cut to form the end tab apertures 128 and 130, or T-shaped end tab apertures 135 and 137.

With regard to dimensional limitations, the two section protective cushioning pad illustrated in FIGS. 7 and 9 of the drawings, would be of substantially the same dimensions as a cushioning pad formed by the block units 70 and 80 with reference to FIG. 2 of the drawings, with the exception that in FIG. 2 of the drawings, no end tabls of the type illustrated by the numerals 124 and 126 respectively are shown.

A protective cushioning pad of the type illustrated in FIGS. 7 and 9 of the drawings is particularly useful for protecting the peripheral edges of any article to be packaged. In this connection, the pad would be merely bent at the fold line intermediate the two block units 120 and 122, by the operator when placing the same over an edge of an article to be packaged, such as a carton or the like. Preferably, and in the preferred embodiment, a plurality of such protective cushioning pads may be bent around any exposed edges of the article to be packaged and held in position by a packing band such as 132 or 140, such that when the article is placed in a container or crate, all of the exposed edges are protected by such cushioning pads. In addition, the three faced corner cushioning pads as illustrated in FIG. 1 through 3 of the drawings may also be utilized to protectively cover any exposed corners of the article, while at the same time using the two sectioned protective cushioning pads to protect the exposed edges.

It will be appreciated from the above description that the present invention provides an improved protective cushioning pad for use in connection with the packing, storage and transportation of articles wherein the protection of the articles against damage or stock is desired. The protective cushioning pads of the present invention are formulated from flat sheets of resilient material with a minimum amount of material wastage, the only wastage being incident to the cut out slots formed in adjoining sections during the manufacture of the completed cushioning pad. In addition, the protective cushioning pads of the present invention are provided with fold retention means which permit the operator to easily bend the pad to any desired angle in order to cover any edge or corner of an article to be packaged and even more importantly, may be re-used in that the cushioning pads may be once again unfolded into a flat disposition for storage purposes. Hence, another cost saving factor is achieved in that the protective cushioning pads as described herein may be used over and over again, such as for example, by people involved in the transportation industry.

Furthermore, the protective cushioning pads as described herein permit easy storage since the same may be stored in a completely flat disposition prior to use, thereby minimizing the warehousing space necessary to store several thousand of such cushioning pads. As indicated above, the pads are easily positioned for use by an operator by merely bending the various sections one with respect to the other when inserting the same in position around an article to be packaged. It will therefore be appreciated that all of the above objects and advantages as well as additional objects and advantages have been achieved by the present invention while at the same time providing a protective cushioning pad which is extremely economical to manufacture and attaining all of the necessary beneficial features which such protective cushioning pads should have.

While there has been described what at present is considered to be the preferred embodiment of the invention, it will be understood that various modifications may be made therein and it is intended to cover in the appended claims all such modifications as fall within the true spirit and scope of the invention.

What is claimed is:

1. A protective cushioning pad for protecting the edges and corners of articles to be packaged, comprising, a substantially flat sheet of resilient material, said sheet of material defined by an L-shaped larger portion including a base portion for the L and an arm portion of the L, said arm portion of the L having two smaller sections adjoining and extending laterally outwardly from said arm portion of the L such that the two smaller portions adjoin said larger section along a fold line, said two smaller sections being separated from each other by a first cut-out slot such that said two smaller sections are separated from each other while each is joined to said larger arm portion of the L along a fold line, the base portion of the L including a smaller section joined thereto and extending upwardly therefrom such that said arm portion of the L-shaped portion forms, with said base portion and said smaller section extending upwardly therefrom a substantially rectangular configuration, said smaller section extending upwardly from said base portion of the L being separated from the arm portion of the L by a second cut-out slot such that said smaller section is separated from the arm portion of the L by said slot while joined to said base portion of the L along a fold line, first deformable fold retention means fixedly secured to said arm portion of the L-shaped section approximately midposition thereof and traversing the line formed by said first cut-out slot and said fold line between said smaller section and said base portion, second deformable fold retention means fixedly secured to said L-shaped portion approximately midposition of the base of said L-shaped portion and traversing the line of said second cut-out slot, each of said two smaller sections being foldable over and onto said adjoining arm portion of said L-shaped section and in overlying relation with respect to said first deformable fold retention means such that said deformable fold retention means is sandwiched between said arm portion of said L-shaped portion and said adjacent two smaller sections when fully assembled, said single smaller section extending upwardly from the base portion of said L being foldable over and onto said base portion of said L-shaped portion and in overlying relation with respect to said second deformable fold retention means, such that said second deformable fold retention means is sandwiched between the base portion of said L-shaped section and said smaller section when fully assembled, and said deformable fold retention means permitting the foldable movement of one-half of said arm portion of said L-shaped portion to be moved arcuately with respect to the opposing one-half portion thereof such that said half sections may assume any pre-selected angularized disposition while said deformable fold retention means functions to retain said half sections in such pre-selected positions and permitting the unfolding of said sections into a substantially flat position for subsequent stacking and storage functions, while said second deformable fold retention means similarly permits the folding movement of the base portion of said L-shaped portion with respect to the arm portion thereof such that said portions may assume any pre-selected angularized position while said second deformable retention means functions to retain said sections in such pre-selected positions and permitting the unfolding of said sections into a substantially flat position for subsequent stacking and storage functions, whereby said protective cushioning pad results in a pad having three discrete sections arcuately movable with respect to one another thereby to assume an intersecting three plane structure suitable for positioning over the corner end of an article to be packaged.

2. The protective cushioning pad as set forth in claim 1, wherein said deformable fold retention means comprises a bendable strip of metal fixedly secured between the folded over discrete sections thereby to be retained between the double layered configuration of said discrete sections.

3. The protective cushioning pad as set forth in claim 1 above, wherein said flat sheet of resilient material is formed of polyethylene.

* * * * *